US005422458A

United States Patent [19]

Simmel

[11] Patent Number: 5,422,458

[45] Date of Patent: Jun. 6, 1995

[54] MULTI-PURPOSE TOY OVEN WITH HEATING, COOLING, AND DOOR CONTROL SYSTEM

[76] Inventor: Thomas L. Simmel, 44 Booras La., Milford, Conn. 06460

[21] Appl. No.: 130,295

[22] Filed: Oct. 1, 1993

[51] Int. Cl.[6] ..... A21B 1/00; A21B 1/22; A63H 3/52

[52] U.S. Cl. ..... 219/391; 219/399; 126/192; 126/275 E; 99/337; 446/481; 446/485

[58] Field of Search ..... 219/391, 399, 400, 405, 219/411, 413, 414, 531, 392, 385, 386, 404, 403; 126/275 R, 275 E, 192, 273 R; 99/337, 338, 331-333, 468, 447; 446/481, 485, 219; 165/61

[56] References Cited

U.S. PATENT DOCUMENTS

| | | | |
|---|---|---|---|
| 1,948,100 | 2/1934 | Drumm | 46/37 |
| 2,864,932 | 12/1958 | Forrer | 219/405 |
| 3,368,063 | 2/1968 | Kuhn | 219/405 |
| 3,548,146 | 12/1970 | Hoyland | 219/392 |
| 3,625,197 | 12/1971 | Pirker et al. | 219/413 |
| 3,808,730 | 5/1974 | Cooper et al. | 46/1 |
| 4,249,067 | 2/1981 | Cummings | 219/405 |
| 4,298,788 | 11/1981 | Jones et al. | 219/386 |
| 4,350,874 | 9/1982 | Nishikawa | 219/400 |
| 4,386,558 | 6/1983 | Holman et al. | 99/386 |
| 4,516,012 | 5/1985 | Smith et al. | 219/400 |
| 4,563,573 | 1/1986 | Hartelius et al. | 219/405 |
| 4,743,728 | 5/1988 | Nagafusa et al. | 219/400 |
| 4,772,243 | 9/1988 | Zeiss | 446/481 |
| 4,781,646 | 11/1988 | Dibley | 446/219 |
| 4,935,604 | 6/1990 | Allen et al. | 219/400 |
| 4,984,512 | 1/1991 | Takahashi et al. | 99/332 |

*Primary Examiner*—John A. Jeffery
*Attorney, Agent, or Firm*—Melvin I. Stoltz

[57] ABSTRACT

By providing a fully integrated timer controlled actuation and locking system that automatically prevents access to the heating chamber whenever the system is engaged, a unique multi-purpose, automatic toy oven is achieved. In the preferred embodiment, the toy oven incorporates a forced air cooling assembly for substantially reducing the time period required for cooling of the heating chamber and product. In addition, the locking system of the present invention preferably prevents access to the heating chamber until both the desired heating and cooling time have expired and both the heating chamber and the heated product can be safely accessed. In addition, the actuation system automatically engages and sequentially times the heating and cooling cycles, to provide an oven which is easy to use and enjoy.

17 Claims, 4 Drawing Sheets

FIG. 7
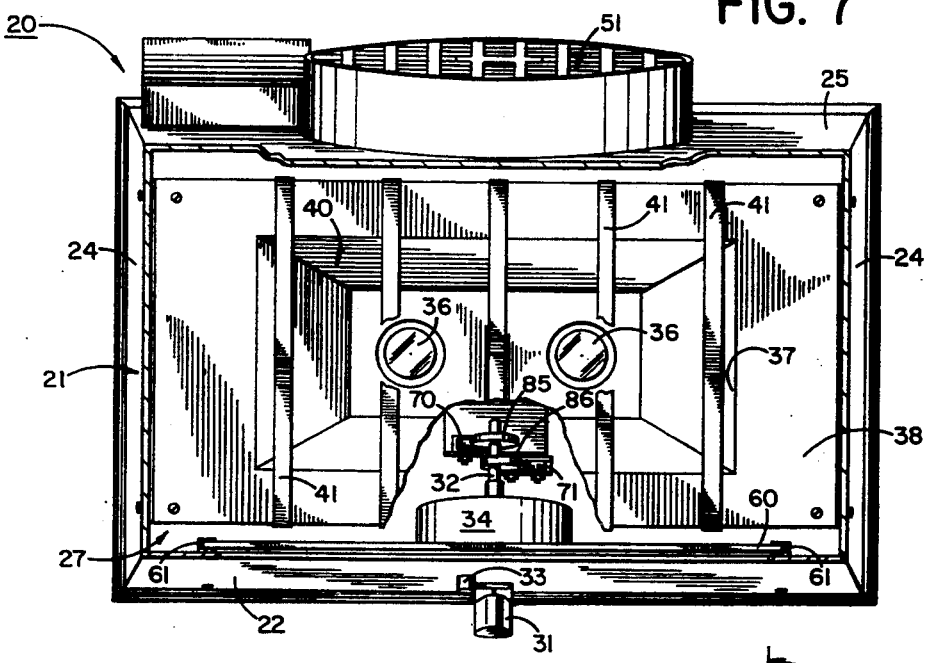
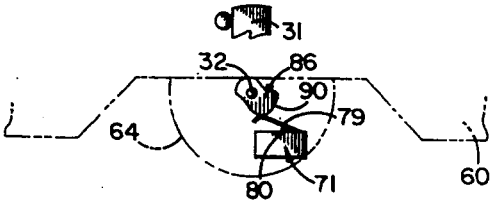
FIG. 8
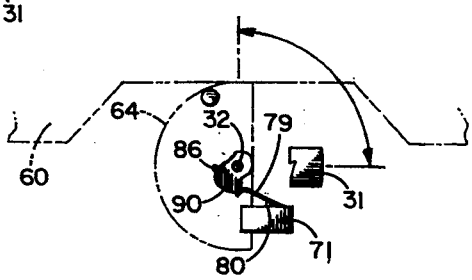
FIG. 9
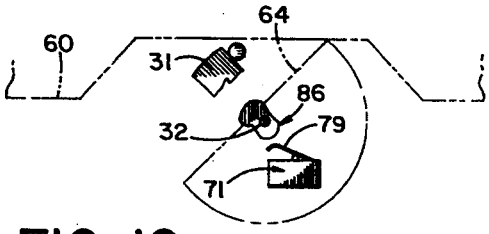
FIG. 10
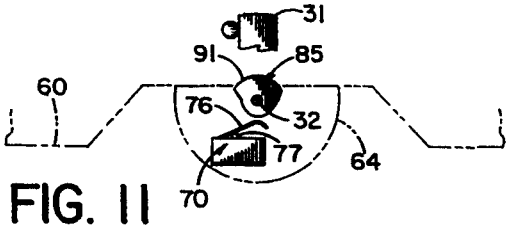
FIG. 11
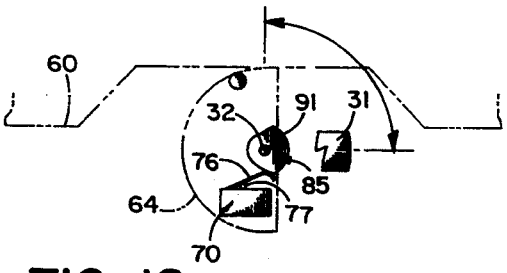
FIG. 12
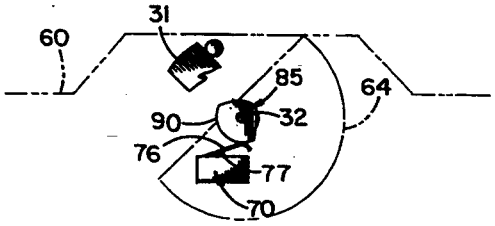
FIG. 13

MULTI-PURPOSE TOY OVEN WITH HEATING, COOLING, AND DOOR CONTROL SYSTEM

TECHNICAL FIELD

This invention relates to toy ovens, and more particularly to multi-purpose toy ovens which operate electrically for heating products designed for use by children.

BACKGROUND ART

For many years, toy ovens have been extremely popular products for use by children, in order to enable a child to cook, on a small scale, various products specially designed for use by children. Such products include food products, craft items, and various toy or play products. Although numerous products have been constructed for being prepared by children in toy ovens and toy ovens have been extremely popular products sold in the marketplace for numerous years, these prior art toy ovens have suffered from common drawbacks which have been incapable of being fully eliminated, until the present invention.

One of the principal difficulties encountered with prior art toy ovens is the inability of these prior art products to be completely safe, assuring that children are incapable of gaining access to heating zones when the zones are hot and can cause severe :injury to a child. Although numerous prior art constructions have been made in an attempt to provide a safe oven which is inaccessible to a child when hot, such prior art constructions have failed to be completely effective in preventing unwanted access to the heating zone or the hot product and the inherent dangers associated therewith.

Another problem typically encountered with prior art toy ovens is the length of time required for cooking and cooling of the product once cooking has been completed. Due to the construction of these prior art toy ovens, either the product being cooked or the oven chamber and product must be fully cooled before the oven and the resulting product is safe for the child to touch. Since the prior art systems employ static ambient air for cooling and the cooking temperature is substantially greater than ambient, a long waiting time is required before it is safe to access the cooking chamber or the cooked product. Since children using toy ovens are extremely anxious for immediate use of the product being cooked, any built-in safeguards for reducing access to the heating chamber or the cooked product are often circumvented by the child, often resulting in burns or other injuries.

A further drawback typically encountered in prior art toy ovens is the expense required to provide built-in safeguards against injury as well as the home assembly required for constructing a disassembled oven. Typically, prior art systems are sold in a kit form, substantially disassembled, in order to reduce manufacturing expenses and enable the manufacturer to sell the product at a more reasonable cost. However, the more safeguards incorporated into the oven to attain added assurance against unwanted injury, the longer the assembly time required. Typically, rapid safeguards require complex assembly, causing the purchaser to incur substantial difficulties and added time.

Therefore, it is a principal object of the present invention to provide a safe and highly efficient toy oven which operates automatically to virtually eliminate access to elevated temperature zones and/or the product when hot.

Another object of the present invention is to provide a toy oven having the characteristic features described above which operates automatically to prevent access to unwanted areas whenever the oven is activated.

Another object of the present invention is to provide a toy oven having the characteristic features described above which substantially reduces the time required for cooling the oven and the products being heated or cooked.

A further object of the present invention is to provide a toy oven,having the characteristics features described above which is capable of being manufactured comparatively inexpensively while also providing a fully operational, safe and efficient oven construction.

Another object of the present invention is to provide a toy oven having the characteristic features described above which is capable of being quickly and easily assembled by the user.

Another object of the present invention is to provide a toy oven having the characteristic features described above which employs a minimum of component parts, thereby enabling the oven to be economically produced and sold substantially fully assembled, virtually eliminating assembly by the consumer.

Another object of the present invention is to provide a toy oven having the characteristic features described above which virtually eliminates a child being able to gain access to unwanted areas of the oven until sufficient time has elapsed to assure safe, trouble-free access.

Other and more specific objects will in part and will in part appear hereinafter.

SUMMARY OF THE INVENTION

In the present invention, the prior art drawbacks and failings are eliminated and a fully integrated, automatic, multi-purpose toy oven is achieved which is easy to use and automatically prevents access to any heating zone and assures that access to the heating zone and the product is prevented until the zone and product are fully and completely cooled. Furthermore, the time required for cooling of the heating zone and product is substantially reduced, thereby preventing children from becoming so anxious that they attempt to dismantle built-in safeguards to gain access to heating areas. Furthermore, the present invention is constructed with a minimum of components which are easily pre-assembled, thereby reducing or virtually eliminating any requirement for assembly by consumers.

In the present invention, many of the prior art drawbacks and difficulties are eliminated by providing a fully integrated timer controlled single actuation system comprising an interlock assembly that automatically closes off access to the heating chamber whenever the system is engaged and continues to prevent access to the heating chamber until the requisite heating and cooling time have expired and both the heating chamber and the heated product can be safely accessed. In addition, the single actuation system automatically engages and sequentially times the heating and cooling cycles, to provide an oven which is easy to use and enjoy.

Furthermore, in order to substantially reduce the time period required for cooling of the heating chamber and the heated product once the requisite heating time has elapsed, the present invention incorporates a forced air cooling assembly. Preferably, the cooling assembly comprises a motor driven fan blade which draws ambient air into the toy oven and directs the air flow through the heating chamber for directly cooling the heating chamber and the cooked product. In this way, static ambient air cooling is eliminated and the time period required for cooling is substantially reduced.

By employing this construction, both heating and cooling is achieved in a comparatively short time period to the great satisfaction of the child seeking to have the product cooked in the toy oven. In addition, as a result of this substantially reduced waiting time, unwanted meddling by anxious children is prevented and a safe and efficient toy oven is realized.

If desired, the oven of this invention can be constructed to achieve all of the timing and interlocking features using electronic controls. In this way, the desired cooking time can be digitally entered and once the system is started, all of the other control functions of this invention are automatically executed.

In an alternate mechanically-based embodiment, a clutch timer is employed which can be rotated in only one direction and, once set for a specific time period, can only be reversed through the timing mechanism and the expiration of the particular time period set by the user. In addition, as mentioned above, the fully integrated, single activation system of this invention incorporates an interlock system which closes the heating chamber immediately upon rotation of a timer setting knob and continues to prevent access to the heating chamber until the timer has returned to the start position.

As a further part of the fully integrated system of this invention, the single actuation knob also controls separate and independent means for starting and stopping the cooling assembly and starting and stopping the heating means for heating the oven chamber. In this way, the rotation of the single actuation knob simultaneously (1) closes the entry zone into the heating chamber of the toy oven (2) actuates the heating means for providing the desired heat to the heating zone of the oven and (3) upon completion of the heating automatically initiates the activation of the cooling assembly for cooling the heating chamber and the product. As a result of this construction, a completely automatic, fully integrated, trouble-free, safe and efficient operation is realized and a substantially improved toy oven construction is attained.

By employing the present invention, which prevents any manual override of the actuation knob once the timing sequence has been initiated, assurance is provided that the heating chamber is heated for the entire selected time cycle and both the heating chamber and the product are completely cooled prior to allowing the user to gain access to the heating chamber, and the product.

In addition, this construction also assures that partial actuation of the timer will only initiate cooling without any heating. As a result, anybody attempting to partially actuate the system by rotating the activation know part way through its complete cooking cycle will only obtain partial heating and a full cooling cycle. Consequently, any attempt to circumvent the initiation of a complete heating and cooling cycle will only produce partial heating and full cooling, while access to the heating chamber will be prevented until the heating chamber has been fully cooled to a safe temperature.

The invention accordingly comprises the features of contruction, combinations of elements and arrangement of parts which will be exemplified in the constructions hereinafter set forth and the scope of the invention will be indicated in the claims.

THE DRAWINGS

For a fuller understanding of the nature and objects of the invention, reference should be had to the following detailed description taken in connection with the accompanying drawings, in which.

Figure 3:
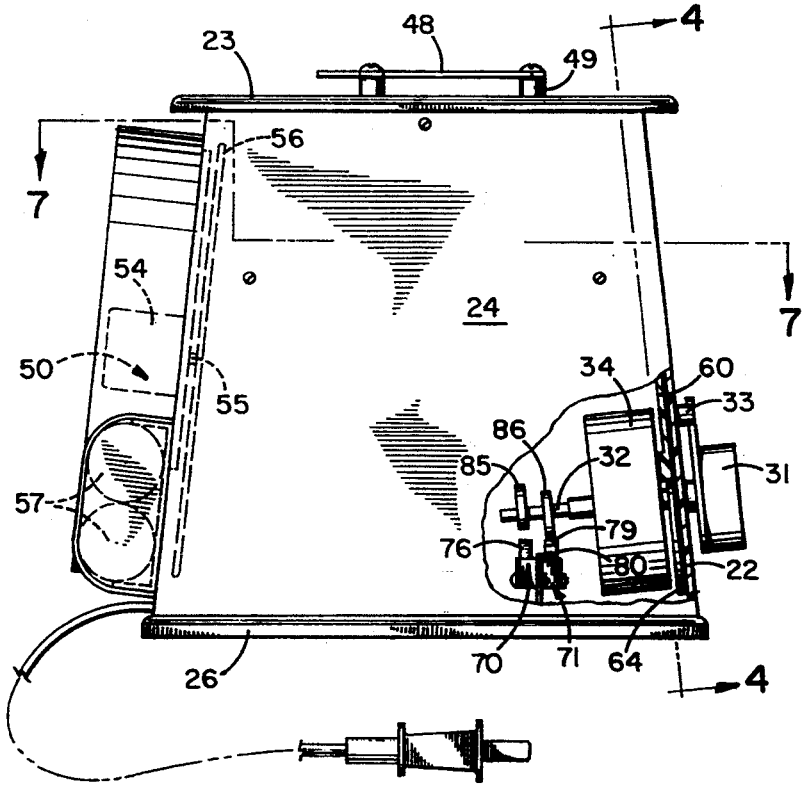
FIG. 3 is a side elevation view, partially broken away and partially in cross-section, of the toy oven of the present invention.

FIG. 7 is a top plan view, partially in cross section and partially broken away, taken along line 7—7 of FIG. 3; and FIGS. 8–13 are diagrammatic views depicting alternate positions of the activating knob of the multi-purpose toy oven of the present invention and the cooperative movements caused thereby with the interlock system and actuation switches incorporated in the multipurpose toy oven of the present invention.

DETAILED DESCRIPTION

By referring to FIGS. 1–7, along with the following detailed disclosure, the preferred construction and operation of multi-purpose toy oven 20 of the present invention can best be understood. As shown therein, multipurpose toy oven 20 comprises a housing 21 which is formed by front panel 22, top panel 23, side panels 24,24, rear panel 25, and base plate 26, all of which combine to establish interior chamber 27.

Preferably, multi-purpose toy oven 20 of the present invention is constructed for receiving a plurality of different products available for children which require heating or cooking, and providing the requisite elevated temperatures for cooking or heating these products. Such products include, but are not limited to, food products, such as cookies, cakes, brownies, etc., craft or play items, such as moldable figures and shapes and plastic products, such as shrinkable forms and coloring plates. In order to enable a broad range of products designed for children to be easily employed in toy oven 20 of the present invention, front panel 22 incorporates elongated entry portal 30, which is constructed for allowing items of any conventional size or shape to be easily inserted into toy oven 20.

As discussed above, the timing and locking features of the present invention can be achieved in an electronic control system. However, for cost reasons, a mechanical system is preferred and is detailed herein. However, this discussion is for exemplary purposes and the electronic system should be considered to be within the scope of this invention.

In the preferred embodiment, toy oven 20 comprises a single activation switch or knob 31 which is rotationally mounted to front panel 22. In the preferred embodiment, knob 31 is mounted on elongated shaft 32 with shaft 32 supportingly retained on front panel 22 for rotational movement relative thereto. As is fully detailed below, the rotational movement of knob 31 and shaft 32 is constructed for automatically activating both the heating and cooling cycles employed in oven 20 of the present invention.

In the preferred embodiment, shaft 32 is cooperatively associated with timer assembly 34 for controlling the rotational movement of shaft 32 in one direction, assuring that shaft 32 rotates in said direction only in response to the allowed movement by the timing mechanism incorporated within timer assembly 34. In this way, timer assembly 34 can be set for any desired period of time and, once activated, cannot be changed or altered without the set time period being allowed to expire.

When in the off position, knob 31 is in abutting contact with stop pin 33 mounted to front panel 22 of toy oven 20. When in this position, toy oven 20 is deactivated, with no heating, cooling, or timing functions occurring. However, whenever knob 31 is arcuately rotated away from stop pin 33, all of the desired functions of toy oven 20 are automatically activated, enabling the entire toy oven system to be operated with the rotation of one single switch or knob.

In the preferred embodiment, shaft 32 is rotationally journalled in timer assembly 34 to enable switch 31 to be rotated away from stop pin 33 in a generally clockwise manner, as viewed from front panel 22, through an arcuate maximum distance of about 355°, until abutting stop pin 33 on its opposed surface. Of course, any alternate, arcuate position less than the maximum rotation can be selected by the user.

Once knob 31 has been arcuately rotated through the desired arcuate distance to initiate timer 34, knob 31 is incapable of being manually rotated in the opposed direction, preventing switch 31 from being able to be changed to a shorter time period or returned to its original stop position in abutting contact with pin 33. Once activated, the rotation of shaft 32 is controlled by timer assembly 34, allowing shaft 32 and knob 31 to return to their original position only by the timed operation of timer assembly 34. In this way, whenever switch 31 and shaft 32 have been rotated for activating timer assembly 34, timer assembly 34 must complete the timed cycle selected before switch 31 and shaft 32 are returned to their original de-activated positions.

Figure 1:
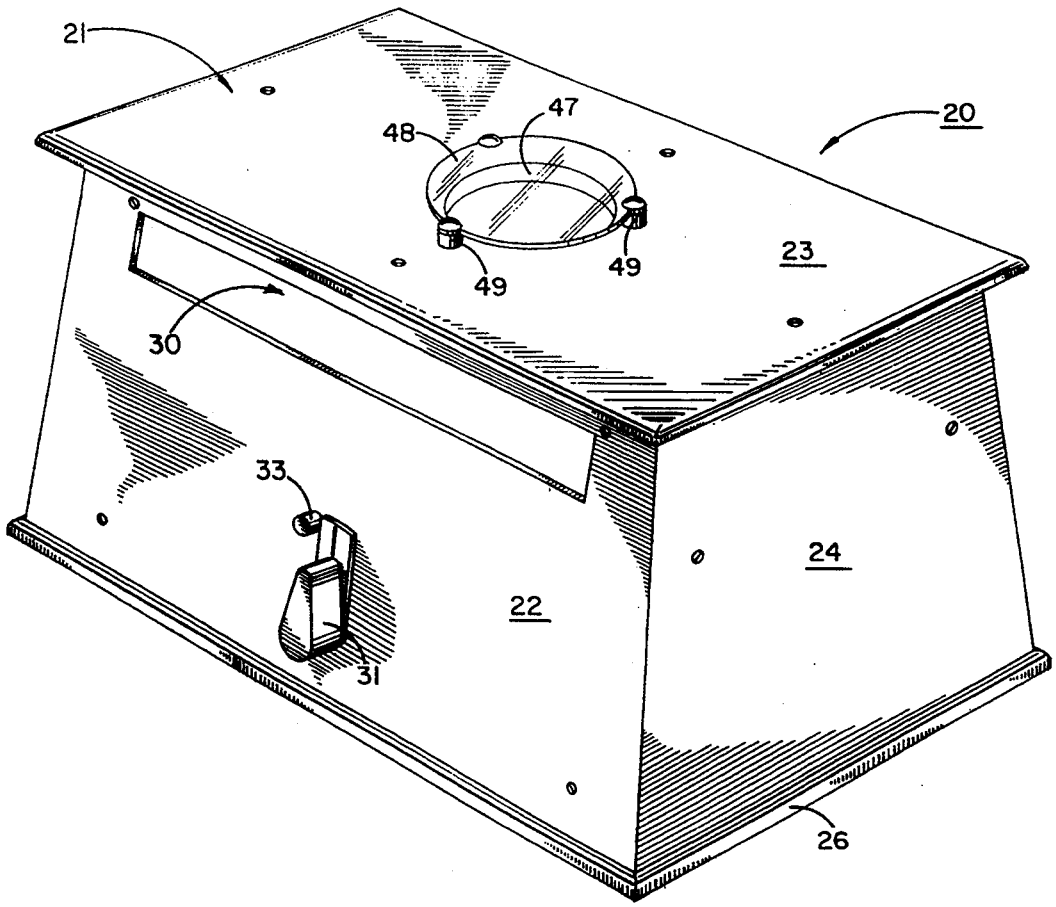
FIG. 1 is a perspective of the fully assembled multipurpose toy oven of the present invention.
Figure 4:
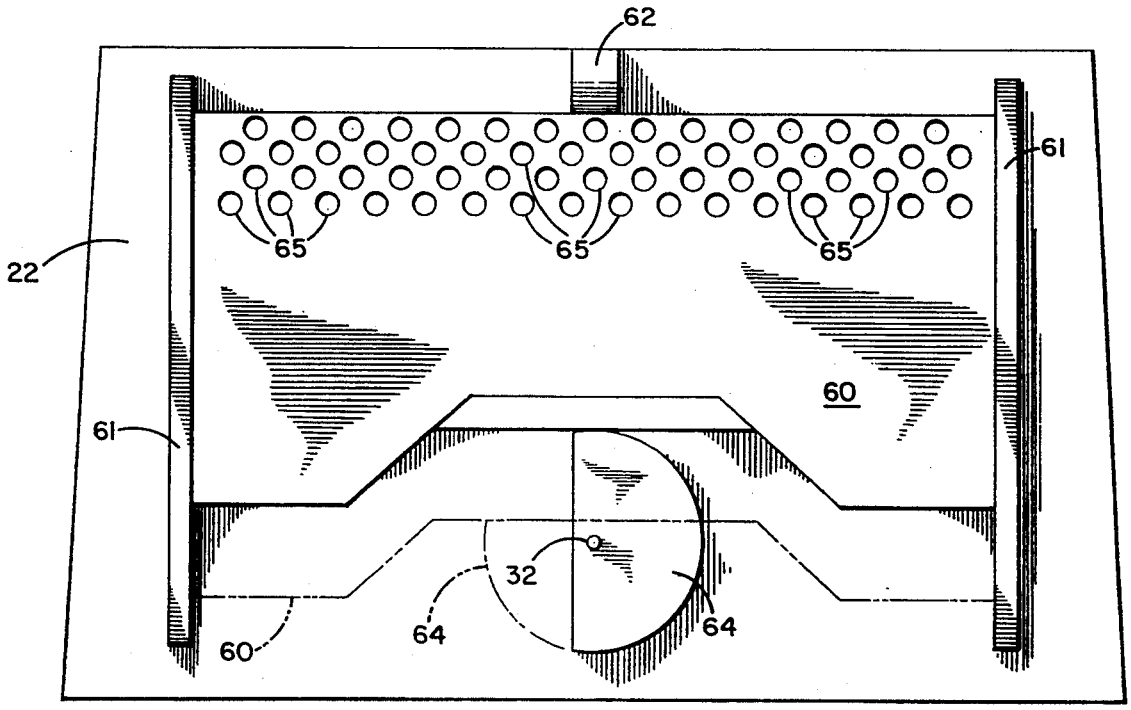
FIG. 4 is a rear elevation view of the inside surface of the front panel of the multi-purpose toy oven of FIG. 1.
Figure 2:
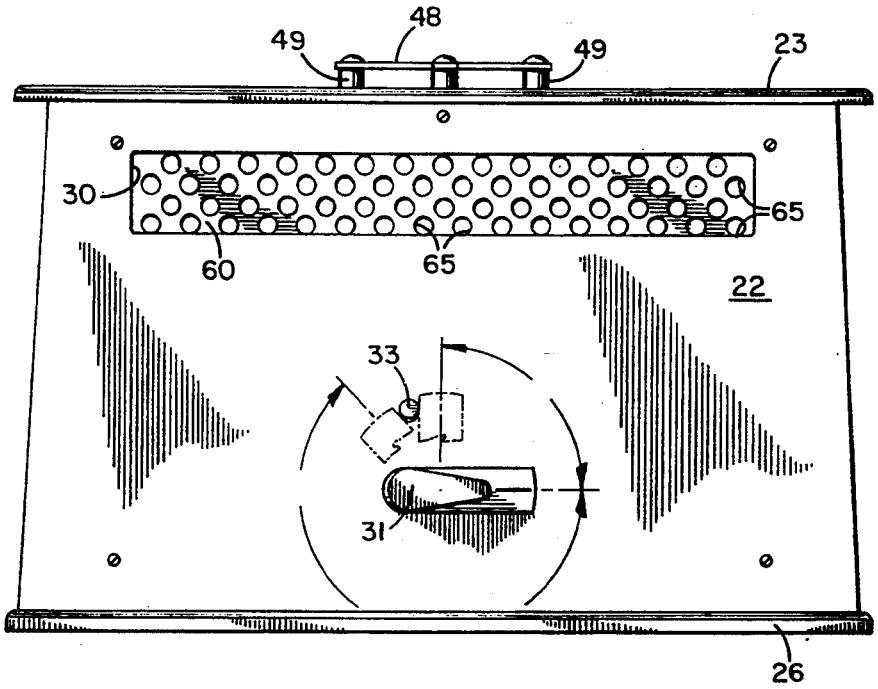
FIG. 2 is a front elevation view of the multi-purpose toy oven of the present invention.

As best seen in FIG. 4, toy oven 20 also incorporates door 60, which is slidably mounted to the inside surface of front panel 22. In the preferred construction, door 60 is able to be slidably moved from a first position, shown in phantom in FIG. 4, wherein entry portal 30 is fully opened as depicted in FIG. 1, to a second position wherein door 60 completely closes entry portal 30, as depicted in FIGS. 2 and 4. In the preferred construction, door 60 incorporates a plurality of holes 65 formed in the area covering portal 30 in order to allow the free flow of air, while preventing anyone from being able to access interior chamber 27 of oven 20.

In order to provide the desired sliding movement of door 60 relative to front panel 22, channel members 61 are mounted to the inside surface of front panel 22, securely retaining door 60 in the desired position and enabling door 60 to slide between its two alternate positions. Furthermore, stop abutment 62 is preferably mounted to panel 22, providing a positive travel stop for door 60 to prevent door 60 from being moved beyond the desired portal closing position.

In order to automatically control the sliding movement of door 60 for opening and closing entry portal 30 of front panel 22, cam member 64 is fixedly mounted to shaft 32 and positioned in abutting controlling contacting relationship with the lower edge of door 60. When switch 31 is in its normal unoperating position in abutting contact with stop pin 33, cam member 64 and door 60 are in the position depicted in phantom in FIG. 4. In this position, door 60 is in its downwardmost position providing full access to the interior of toy oven 20 through entry portal 30.

Since cam member is 64 fixedly mounted to shaft 32 so as to be simultaneously rotated therewith whenever switch 31 and shaft 32 are rotated, the activation of toy oven 20 by rotating switch 31 and shaft 32 automatically causes cam member 64 to rotate. As a result, as shown in FIG. 4, the rotation of cam member 64 forces door 60 to move upwardly, raising door 60 to its upper limit, completely closing entry portal 30.

By employing this construction, the single actuation of switch 31 and shaft 32 automatically causes door 60 to be moved from its open position to its closed position, due to the simultaneous rotation of cam means 64. In addition, as is fully detailed below, both the heating and cooling cycles are automatically activated at the appropriate time, by the timed rotation of shaft 32. As is evident from the foregoing disclosure, as well as the additional disclosure provided below, the single rotation of knob or switch 31 and shaft 32 automatically engages all of the desired functions incorporated into toy oven 20, providing an easily operated oven which achieves the desired heating and cooling in a completely safe and efficient manner.

Figure 6:
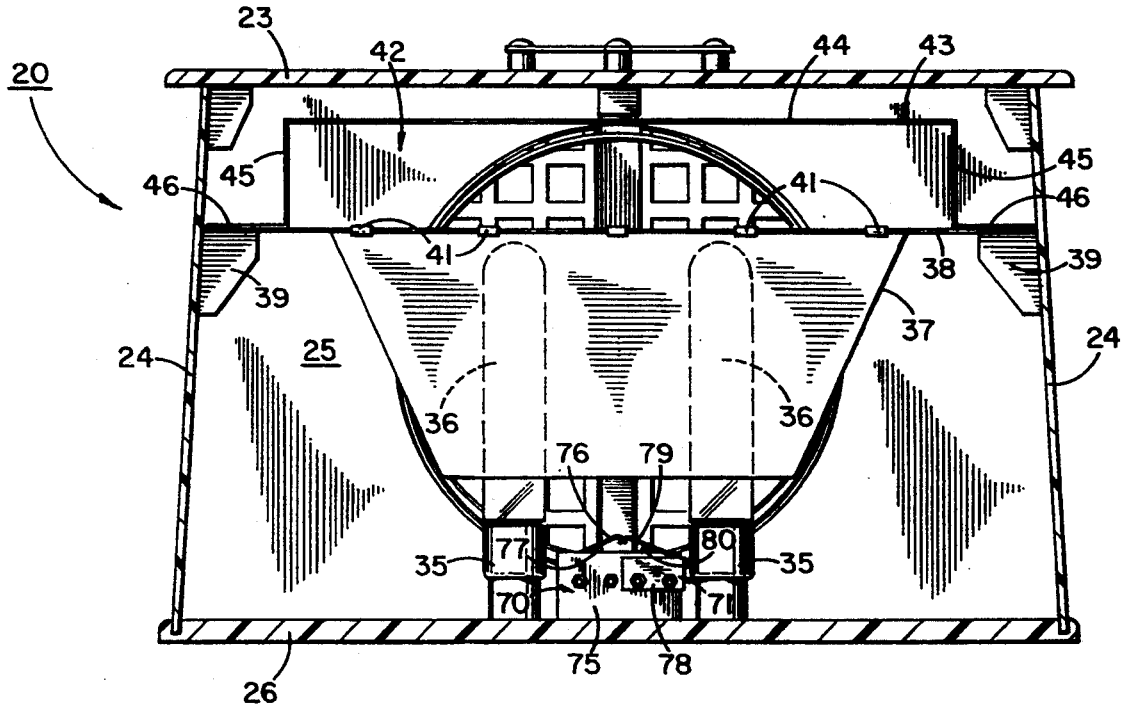
FIG. 6 is a front elevation view of the toy oven of the present invention with the front panel removed.

As clearly shown in FIGS. 6 and 7, multi-purpose toy oven 20 of the present invention is constructed in a generally conventional manner for providing the desired heat to the product to be cooked or heated. In this regard, chamber 27 of housing 21 incorporates the requisite components for providing the desired elevated temperatures for heating or cooking the products desired by the user.

Preferably, multi-purpose toy oven 20 incorporates two lamp sockets 35 mounted to base 26 within which incandescent bulbs 36 are threadedly engaged. Sockets 35 are preferably operated by being connected in the conventional manner to typical household electrical current. Bulbs 36 may comprise any desired size or shape, with the only requirement being the use of light bulbs which will provide sufficient heat for cooking or heating of the product desired. Furthermore, although two separate and independent incandescent bulbs are preferred for the particular sized toy oven 20 depicted in the drawings, any desired number of bulbs can be employed, without departing from the scope of this invention.

In order to maximize the delivery of the heat from incandescent bulbs 36, the present invention preferably incorporates a conventional heat channeling hollow shield 37. In the preferred embodiment, shield 37 comprises a generally trapezoidal shape formed from conventional heat reflecting material. In addition, shield 37 peripherally surrounds incandescent bulbs 36 and is otherwise substantially closed at its base and open at its top. In this way, the heat produced by incandescent bulbs 36 is retained within the interior zone defined by shield 37, flowing upwardly through the open top of shield 37.

In order to provide a surface for receiving and holding the product to be heated or cooked, multi-purpose toy oven 20 incorporates a support shelf 38, which is maintained in the desired position within chamber 27 of housing 21 by a plurality of brackets 39 affixed to side panels 24,24. In the preferred embodiment, shelf 38 is positioned in mating, overlying engagement with heat channeling shield 37, with shield 37 extending from the lower surface of shelf 38. In addition, shelf 38 incorporates a large portal 40 which is dimensioned to peripherally surround the open top of shield 37. In this way, substantially all of the heat generated by incandescent light bulbs 36 is channeled directly upwardly through enlarged open portal 40 of shelf 38 for heating the product placed on shelf 38.

In order to complete the construction of shelf 38, a plurality of elongated support strips 41 are mounted to shelf 38 spanning portal 40. Strips 41 provide a supporting surface directly overlying portal 40 in order to enable the products to be placed directly over portal 40 for receiving the optimum concentration of heat from bulbs 36.

In order to further concentrate the heat provided by incandescent bulbs 36, and establish a specific, defined heating zone 42, a heat concentrating plate 43 is preferably mounted to the top surface of shelf 38. As shown in FIG. 6, heat concentrating plate 43 comprises a top surface 44, two depending side walls 45, which are positioned in juxtaposed spaced cooperating relationship with heat passageway 40, and two support flanges 46, mounted to shelf 38. In this way, heating zone 42 is formed by top surface 44, side walls 45, portal 40 of shelf 38.

Preferably, the overall size and shape of heating zone 42 is constructed to substantially coincide with the size and shape of entry portal 30 of front panel 22 of housing 21. In this way, when any item to be heated or processed is inserted into entry portal 30 of oven 20, the product is automatically placed on elongated support strips 41 of support shelf 38, for receiving the direct heating from bulbs 36, when the bulbs are turned on.

Furthermore, the heat rising through portal 40 of shelf 38 is further concentrated in heating zone 42 by top panel 44 and side surfaces 45 of heat concentrating plate 43. In this way, optimum heating is provided directly in heating zone 42, assuring the delivery of heat to the precise area in which the items to be cooked or heated are located.

In order to complete the normal heat flow path, top panel 23 incorporates a portal 47 formed therein. In this way, the normal upward flow of the heated air is maintained and allowed to continue throughout the heating cycle. Preferably, a protective plate 48 is mounted above portal 47 on upstanding posts 49. By employing plate 48, the existing heated air is diffused and any possibility that a child might place a finger into portal 47 and contact plate 43 is eliminated. As a result, possible injury to a child is prevented.

One of the unique aspects of the present invention is the incorporation of fan means 50 into multi-purpose oven 20 in order to provide a controlled, positive flow of ambient air to speed the cooling of heating chamber 42 and the product being cooked or heated therein. By incorporating fan means 50 in toy oven 20, a controlled, positive flow of air is provided and the cooling time period is substantially reduced. As a result, the child using toy oven 20 is able to enjoy the finished product much more rapidly than with prior art toy ovens.

In the preferred embodiment, rear panel 25 of housing 21 of multi-purpose oven 20 comprises an enlarged open mesh zone 51 for enabling ambient air to pass freely therethrough. In addition, support ribs or posts 52 are positioned in juxtaposed spaced facing relationship with mesh zone 51, providing a support plane for fan means 50. In the preferred embodiment, three separate radially extending support posts 52 are employed, with the posts 52 intersecting in juxtaposed spaced relationship to the center of open mesh zone 51.

Figure 5:
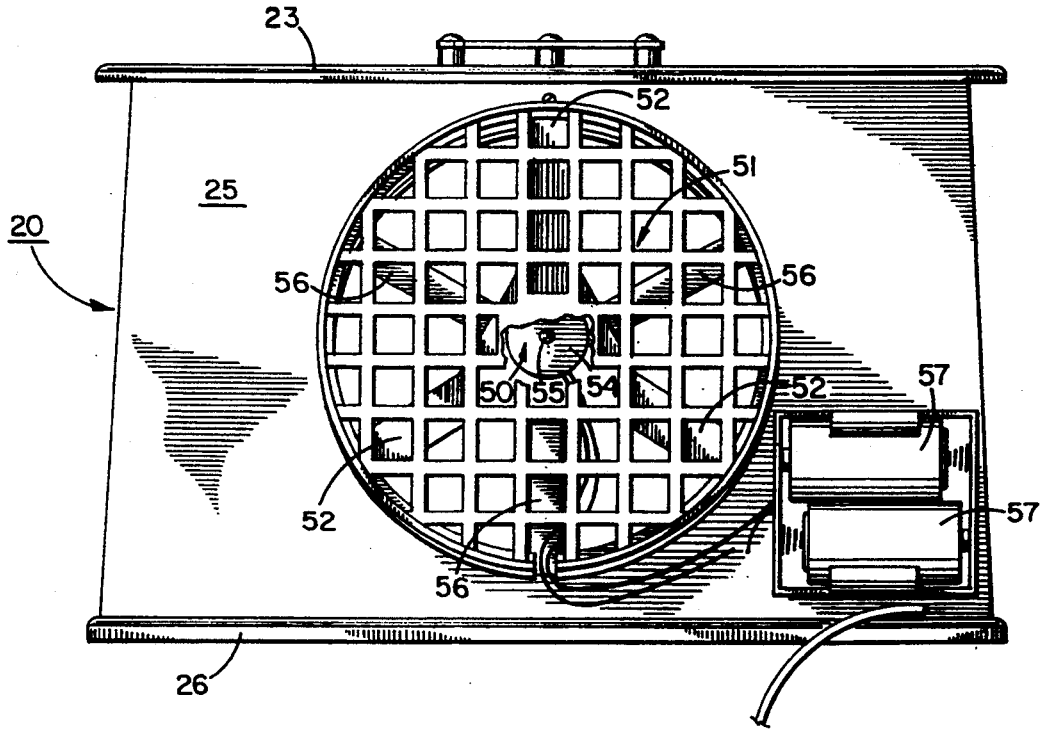
FIG. 5 is a rear view of the multi-purpose toy oven of the present invention.

As best seen in FIGS. 3 and 5, fan means 50 preferably comprises a motor 54, an output shaft 55, and a fan blade assembly 56. In the preferred embodiment, motor 54 is mounted to support posts 52 at the centrally disposed intersection thereof, with output shaft 55 extending through support posts 52 and blade assembly 56 mounted at the terminating end of shaft 55.

By employing the preferred construction, the actuation of motor 54 causes shaft 55 to continuously rotate, thereby causing fan blade assembly 56 to be rotationally driven therewith. With the fan blades of blade assembly 56 angled in the proper direction, the rotation of the fan blades continuously draws ambient air through holes 65 of door 60 into interior chamber 27 of housing 21, establishing a continuously, fan-blade driven, flow of air from door 60 toward rear panel 25. Since open mesh zone 51 comprises the only exit zone for the air flow on rear panel 25, the air flow generated by the rotation of fan means 50 forces the positive cooling air to pass through heating chamber 42, reducing the temperature within chamber 42 as well as the temperature of the products retained thereon, while exiting through mesh zone 51.

As a result, cooling time is substantially reduced and the child is able to enjoy the finished product much more quickly than attainable with prior art systems. In addition, the long waiting time encountered with prior art ovens is virtually eliminated and the principal reason for attempting to override safety measures is removed.

As best seen in FIGS. 3, 6, and 7, the construction of toy oven 20 of the present invention is completed by mounting switch means 70 and 71 in interior chamber 27 of toy oven 20. In the preferred construction, switch means 70 is connected between lamp sockets 35 and the incoming household current used to activate lamp sockets 35 and light bulbs 36.

Although virtually any desired spring biased switch member can be employed, the preferred switch means 70 comprises a housing 75 in which an arcuately movable pivot arm 76 is mounted with its distal end free to pivot in response to an actuating force. In addition, upstanding switch activating pin member 77 protrudes from housing 75 in contact with arm 76.

In the preferred operation, switch activating pin member 77 is spring biased and normally maintained in the fully extended "OFF" position. However, pin member 77 is moved downwardly into the "ON" position by the downward arcuate movement of pivot arm 76. Once the actuating force is removed from arm 76, the spring forces acting upon pin member 77 cause pin member 77 to move upwardly, returning to the OFF position, while simultaneously moving pivot arm 76 back to its original position.

Similarly, switch means 71 comprises a housing 78, an arcuately movable pivot arm 79, and an upstanding switch activating pin member 80. In addition, upstanding activating pin member 80 is spring biased, and maintained in the OFF position in abutting contact with pivot arm 79.

In operation, in order to actuate switch means 71, an actuating force causes pivot arm 79 to be arcuately moved downwardly, forcing upstanding activating pin member 80 to be moved, from its OFF position, downwardly into its ON position. Once the actuating force has been removed from pivot arm 76, the spring forces acting upon upstanding activating pin member 80 automatically forces activating pin member 80 upwardly, into its OFF position, simultaneously causing pivot arm 79 to move upwardly into its original position.

As detailed above, the present invention is constructed to be fully operational with the single rotation of knob 31 and shaft 32. In order to achieve this fully integrated single actuation system in an easy-to-use manner, switch engaging cams 85 and 86 are fixedly mounted to shaft 32 for rotation therewith.

As is more fully detailed below, the activation of timer assembly 34 by the simultaneous rotation of knob 31 and elongated shaft 32 causes switch engaging cams 85 and 86 to be simultaneously rotated with the rotation of shaft 32. As detailed above, this rotation also causes cam member 64 to be rotated in order to be automatically raise door 60 into its portal closed position. In the preferred construction, switch engaging cam 85 contacts pivot arm 76 at the appropriate time in order to close the switch and allow the electrical current to flow through to lamp sockets 35 and illuminate light bulbs 36, providing the desired heat. In addition, cam surface 91 of switch engaging cam 85 is constructed to be disengaged from pivot arm 76 when heating is not required, thereby deactivating the illumination of light bulbs 36 by opening switch means 70, preventing power flow to lamp sockets 35.

In a generally similar manner, switch engaging cam 86 contacts pivot arm 79 to move downwardly, closing the circuit between battery 57 and fan blade assembly 50 for automatically activating the rotation of the fan blade assembly when desired. At the completion of the desired cooling cycle, switch engaging cam 86 is disengaged from pivot arm 79, causing switch means 71 to return to its OFF position, shutting off power to fan assembly 50.

By employing this construction, the single rotation of knob 31 and shaft 32 automatically causes door 60 to be raised to prevent access to the interior 27 of oven 20 while also automatically initiating both the heating cycle, by illuminating bulbs 36, and the cooling cycle by initiating the operation of fan assembly 50. As a result, all of the desired operation and requisite functions needed for providing an effective toy oven are attained with the single rotation of a single system activating member.

In order to better understand the activation of the heating cycle and the cooling cycle by merely rotating knob 31 and shaft 32, reference should be made to FIGS. 8–13, along with the following detailed disclosure. In FIGS. 8 through 13, diagrammatic views are provided representing alternate positions of knob 31 along with the corresponding simultaneous positions resulting therefrom of slidable door 60, cam means 64 and switch engaging cams 85 and 86, along with the effect on switch means 70 and 71.

In FIGS. 8 and 11, the normal system deactivated position is depicted wherein the entire system is in its OFF mode. In this position, door 60 is in contact with cam member 64 in a manner which maintains door 60 in its lowermost position, with entry portal 30 completely open for ease of use.

In addition, one end of camming surface 90 of switch engaging cam 86 is touching pivot arm 79 of fan assembly activating switch means 71. However, in this position, upstanding, activating pin member 80 is in its fully raised, OFF position. Similarly, as shown in FIG. 11, lamp activating switch means 70 is also in the OFF position, since switch engaging cam 85 is completely disengaged from pivot arm 76 thereof.

In FIGS. 9 and 12, the relative position of the cam members and switch means is depicted when knob 31 has been rotated through an arcuate distance of 90°. As shown in both FIGS. 9 and 12, the rotation of knob 31 through an arc of 90° causes cam member 64 to contact door 60, lifting door 60 to its fully raised position, whereby entry portal 30 of front panel 22 is completely closed. In addition, as shown in FIG. 9, fan means activating cam member 86 is disengaged from switch means 71, with pivot arm 79 contacting the opposite end of camming surface 90 of switch engaging cam 86, with upstanding activating pin member 80 fully extended in its OFF position.

By comparing the positions of switch activating cam 86 in FIGS. 8 and 9, it is evident that the pivot arm contacting cam surface 90 of cam 86 is constructed for contacting pivot arm 79 and activating switch means 71 whenever knob 31 moves from the 90° position, shown in FIG. 9, to the 0° position shown in FIG. 8. During this controlled time period, cam surface 90 of cam 86 frictionally engages pivot arm 79 forcing pivot arm 79 downwardly, causing activating pin member 80 to move into its ON position. Once in the ON position, switch means 71 is closed and current is allowed to flow from batteries 57 to fan assembly 50.

As timer assembly 34 causes shaft 32 and knob 31 to rotate towards the zero position depicted in FIG. 8, camming surface 90 of cam 86 is maintained in contact with pivot arm 79, thereby assuring the continuing operation of fan assembly 50 throughout the entire arcuate travel of shaft 32 and knob 31 through the 90° arc. However, once switch 31 has reached the 0° position, depicted in FIG. 8, cam surface 90 becomes disengaged from pivot arm 79, allowing pivot arm 79 to move upwardly in response to the biased force of activating pin member 80. This movement causes switch means 71 to be moved from the ON position into the OFF position, ceasing the operation of fan assembly 50.

Similarly, as knob 31 moves through the 90° arcuate position depicted between FIGS. 8 and 9, cam member 64 maintains door 60 in the raised position, blocking entry portal 30 of front panel 22 until switch 31 has reached the position depicted in FIG. 8, wherein door 60 is lowered into its downward position, providing full access to portal 30. In addition, as shown in FIG. 10, the position of knob 31 beyond 90° has no effect on switch means 71, since camming surface 90 of switch engaging cam 86 is moved further away from pivot arm 79 of switch means 71 as knob 31 is rotated beyond 90°.

As shown in FIG. 12, the rotation of knob 31 through an arc of 90° causes switch engaging cam 85 to bring one end of its camming surface 91 into contact with pivot arm 76 of switch means 70 in a manner whereby switch means 70 is at the threshold of the OFF position, remaining off as long as knob 31 is not rotated any further than 90°. As depicted in FIGS. 12 and 13, whenever knob 31 and shaft 32 are rotated through an arcuate distance greater than 90°, up to and including the full rotation of about 355°, as depicted in FIG. 13, cam surface 91 of switch activating cam 85 frictionally engages pivot arm 76 of switch means 70, causing upstanding activating pin member 77 to move into its ON position, closing switch means 70 and allowing the power to flow to sockets 35 and light bulbs 36. As a result, any position beyond 90° automatically causes light bulbs 36 to be turned on and maintained in the fully illuminated position until the timer has moved switch means 31 to the 90° position, depicted in FIG. 12.

It is also evident from FIG. 13 that cam means 64 rotates with knob 31 and shaft 32 in a manner which maintains door 60 in the fully raised position. Similarly, as knob 31 automatically rotates back, due to the timing mechanism of timer assembly 34, from the position depicted in FIG. 13 to the position depicted in FIG. 12, cam member 64 is maintained in contact with door 60, so as to keep door 60 in the fully raised position. In this way, assurance is provided that entry portal 30 of front panel 22 is maintained closed throughout the entire heating cycle, as well as the entire cooling cycle.

As is evident from the foregoing detailed disclosure, toy oven 20 of the present invention is constructed for allowing any desired product to be heated or cooked in a manner which is easily operated and enables security and simplicity. By employing the present invention, the rotation of a single activation knob or switch automatically causes the entry portal to be closed and maintained closed throughout the cooking and cooling cycle, while also automatically activating the heating cycle and, when completed, automatically activating the cooling cycle.

Furthermore, by preventing any advancement of the activation knob once a heating and cooling cycle has been selected, the system automatically operates assuring that both heating and cooling will be sequentially conducted with the entry portal closed, preventing accidental and unwanted injuries. In addition, the unique construction of the present invention also provides a toy oven wherein cooling is attained more rapidly than in prior art systems, thereby enabling the child using toy oven 20 to enjoy the cooked product much more quickly than attainable with prior art systems.

It will thus be seen that the objects set forth above, among those made apparent from the preceding description are efficiently attained and, since certain changes may be made in the above article, without departing from the scope of the present invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. A toy oven for heating or cooking child-oriented products in a safe, easy, and efficient manner, said oven comprising A. a housing defining an interior chamber formed thereby;

B. an entry portal formed in the housing for enabling the user to insert the product to be heated/cooked into the interior chamber of the housing;

C. a heating zone a. formed within the interior chamber of the housing, b. positioned in juxtaposed, spaced, cooperating relationship with the entry portal, and c. constructed for receiving and supportingly maintaining the product to be heated throughout the heating process;

D. heating means contained within the interior chamber and positioned in cooperating relationship with the heating zone for delivering heat to the heating zone for heating the product; and E. an air flow producing member mounted in the housing and constructed for drawing ambient air into the interior chamber of the housing and directing a flow of said ambient air through the heating zone to provide a positive flow of cooling air directly to the heating zone;

F. a movable door a. cooperatively associated with the entry portal, b. movable from a first portal open position to a second portal closing position, and c. responsive to cam means cooperatively associated therewith; and G. cam means positioned in direct contacting relationship with the door for controlling the movement of the door between its open and closed positions.

2. The toy oven defined in claim 1, wherein said oven further comprises

H. system activating means comprising a. control means positioned on the housing for ease of use, b. a timer assembly connected to said control means for activation thereby, c. first switch means controllably connected to said heating means for activating and deactivating the heating means, thereby defining a heating cycle, d. second switch means controllably connected to the air flow producing member for activating and deactivating the air flow producing member, and e. said door controlling cam means constructed for moving the door from its first open position to its second closed position and maintaining the door in its second closed position throughout the entire heating cycle and cooling cycle, whereby a multi-purpose toy oven is attained which is capable of being easily employed by initiating the activation means for simultaneously activating all functions and operations of the toy oven to provide the desired heating and cooling of the product to be cooked.

3. The toy oven defined in claim 2, wherein said heating means is further defined as comprising at least one light bulb mounted receiving socket, wired with an electric power delivery cord for receiving conventional household current for illuminating a light bulb mounted therein and generating heat therefrom, and said first switch means of said system activating means is further defined as being mounted along the electric power delivery cord for controlling the activation and deactivation of electric power to said socket.

4. The toy oven defined in claim 3, wherein said air flow producing member is further defined as comprising a. an electrically driven motor connected to a power source, and b. a fan blade assembly 1. mounted to the electrically driven motor for rotation thereof when said motor is activated, and
2. constructed for drawing ambient air into the interior chamber of the housing and forcing said air through the housing chamber for cooling the interior thereof.

5. The toy oven defined in claim 4, wherein said electrically driven motor is further defined as being powered by batteries.

6. The toy defined in claim 4, wherein said second switch means of the activation means is further defined as being connected between the motor and its power source for controllably activating and deactivating the rotation of the fan blade.

7. The toy oven defined in claim 3, wherein said oven is further defined as comprising I. first cam means cooperatively associated with the first switch means for activating the first switch means for initiating the heating cycle and deactivating the switch means for terminating the heating cycle.

8. The toy oven defined in claim 7, wherein said oven is further defined as comprising J. second cam means cooperatively associated with the second switch means for activating the second switch means to initiate the cooling means and deactivating the second switch means when termination of the cooling means is desired.

9. The toy oven defined in claim 8, wherein the control means of the system activating means is further defined as comprising a movable control knob rotationally mounted to the housing for use, with said control knob comprising a single elongated shaft upon which the timer assembly, the first cam means, and the second cam means are affixed for being simultaneously rotated with the rotational movement of said control knob, whereby the single rotational movement of said control knob causes the timer assembly, the first cam means, and the second cam means to be simultaneously rotated therewith.

10. The toy oven defined in claim 9, wherein said first cam means and said second cam means are further defined as being positioned on said shaft of the control knob for sequentially contacting the switch means with which each cam means is associated, whereby the heating cycle is first activated without activating the cooling cycle and the cooling cycle is activated only upon deactivation of the heating cycle.

11. The toy oven defined in claim 10, wherein said timer is further defined as being constructed to enable rotation of the shaft of the control knob in only a single direction for setting an overall time interval, while being incapable of manually activated rotation in the opposite direction, thereby preventing the reduction of any time cycle by manual movement of the control knob.

12. The toy oven defined in claim 11, wherein said door activating means is further defined as comprising third cam means mounted on the shaft of the control knob for simultaneous rotation thereof with the rotation of said shaft.

13. The toy oven defined in claim 12, wherein said third cam means is further defined as constructed for controlling cooperation with the door member for maintaining the door member in its open position when the central knob is in its unactivated position and controllably moving and maintaining the door member in its closed position whenever the control knob is in a timer engaged position.

14. A toy oven for heating or cooking child-oriented products in a safe, easy and efficient manner, said toy oven comprising A. a housing defining an interior chamber formed thereby;

B. an entry portal formed in the housing for enabling the user to insert the product to be heated/cooked into the interior chamber of the housing;

C. a heating zone
   a. formed within the interior chamber of the housing,
   b. positioned in juxtaposed, spaced, cooperating relationship with the entry portal, and
   c. constructed for receiving and supportingly maintaining the product to be heated throughout the heating process;

D. heating means contained within the interior chamber and positioned in cooperating relationship with the heating zone for delivering heat to the heating zone for heating the product;

E. cooling means mounted in the housing and comprising
   a. an electrically driven motor connected to a power source, and
   b. a fan blade assembly
      1. mounted to the electrically driven motor for rotation thereof when said motor is activated, and
      2. constructed for drawing ambient air into the interior chamber of the housing and forcing said air through the heating zone to provide a positive flow of cooling air thereto;

F. a movable door member
   a. cooperatively associated with the entry portal,
   b. movable from a first portal open position to a second portal closing position, and
   c. responsive to actuating means cooperatively associated therewith for controlling the movement of the door member between its open and closed positions;

G. system activating means comprising
   a. control means positioned on the housing for ease of use and comprising a movable control knob rotationally mounted to the housing and incorporating an elongated shaft,
   b. a timer assembly connected to the shaft of the movable control knob for activation thereof,
   c. first switch means controllably connected to said heating means for activating and deactivating the heating means, thereby defining a heating cycle,
   d. second switch means controllably connected to the cooling means for activating and deactivating the cooling means, thereby defining a cooling cycle, and
   e. door activating means comprising a first cam member mounted to the shaft of the control knob and constructed for moving the door member from its first open position to its second closed position and maintaining the door member in its second closed position throughout the entire heating cycle and cooling cycle;

H. second cam means mounted to the shaft of the control knob and cooperatively associated with the first switch means for activating the first switch means for initiating the heating cycle and deactivating the switch means for terminating the heating cycle; and I. third cam means mounted to the shaft of the control knob and cooperatively associated with the second switch means for activating the second switch means to initiate the cooling means and deactivating the second switch means when termination of the cooling means is desired;

whereby a multi-purpose toy oven is attained which is capable of being easily employed by initiating the activation means for simultaneously activating all functions and operations of the toy oven to provide the desired heating and cooling of the product to be cooked.

15. The toy oven defined in claim 14, wherein said second cam means and said third cam means are further defined as being positioned on said shaft of the control knob for sequentially contacting the switch means with which each cam means is associated, whereby the heating cycle is first activated without activating the cooling cycle and the cooling cycle is activated only upon deactivation of the heating cycle.

16. The toy oven defined in claim 14, wherein said timer is further defined as being constructed to enable rotation of the shaft of the control knob in only a single direction for setting an overall time interval, while being incapable of manually activated rotation in the opposite direction, thereby preventing the reduction of any time cycle by manual movement of the control knob.

17. The toy oven defined in claim 16, wherein said first cam means is further defined as constructed for controlling cooperation with the door member for maintaining the door member in its open position when the central knob is in its unactivated position and controllably moving and maintaining the door member in its closed position whenever the control knob is in a timer engaged position.

* * * * *